US007877820B2

(12) United States Patent
Landi et al.

(10) Patent No.: US 7,877,820 B2
(45) Date of Patent: Feb. 1, 2011

(54) ARTIFICIAL DISC

(75) Inventors: James Landi, West Orange, NJ (US); Michael Landi, Glen Ridge, NJ (US)

(73) Assignee: XO Athletic, Co., Union, NJ (US)

( * ) Notice: Subject to any disclaimer, the term of this patent is extended or adjusted under 35 U.S.C. 154(b) by 0 days.

(21) Appl. No.: 12/023,664

(22) Filed: Jan. 31, 2008

(65) Prior Publication Data

US 2008/0178371 A1 Jul. 31, 2008

Related U.S. Application Data

(60) Provisional application No. 60/898,449, filed on Jan. 31, 2007.

(51) Int. Cl.
*A41D 13/00* (2006.01)

(52) U.S. Cl. ..... 2/463

(58) Field of Classification Search ..... 2/455, 2/114, 115, 247, 108, 69, 94, 2.5, 463
See application file for complete search history.

(56) References Cited

U.S. PATENT DOCUMENTS

| | | | | |
|---|---|---|---|---|
| 2,629,094 | A | 2/1953 | Goldsmith | |
| 4,481,679 | A | 11/1984 | Hayes | |
| 4,507,801 | A | 4/1985 | Kavanagh et al. | |
| 4,610,034 | A | 9/1986 | Johnson | |
| 4,748,996 | A | 6/1988 | Combier | |
| 5,093,931 | A | 3/1992 | LaBerge et al. | |
| 5,168,576 | A | 12/1992 | Krent et al. | |
| 5,245,706 | A | 9/1993 | Moschetti et al. | |
| 5,325,538 | A * | 7/1994 | Schoenweiss et al. | 2/2.5 |
| 5,423,087 | A | 6/1995 | Krent et al. | |
| 5,621,914 | A * | 4/1997 | Ramone et al. | 2/463 |
| 5,794,261 | A | 8/1998 | Hefling | |
| 5,920,915 | A | 7/1999 | Bainbridge et al. | |
| 5,975,984 | A | 11/1999 | Tart | |
| 5,978,961 | A * | 11/1999 | Barker | 2/2.5 |
| 6,032,300 | A | 3/2000 | Bainbridge et al. | |
| 6,055,676 | A | 5/2000 | Bainbridge et al. | |
| 6,070,273 | A | 6/2000 | Sgro | |
| 6,098,209 | A | 8/2000 | Bainbridge et al. | |
| 6,145,134 | A | 11/2000 | Davis et al. | |
| 6,301,722 | B1 | 10/2001 | Nickerson et al. | |
| 6,305,031 | B1 | 10/2001 | White | |
| 6,357,054 | B1 | 3/2002 | Bainbridge et al. | |
| 6,453,477 | B1 | 9/2002 | Bainbridge et al. | |
| 6,485,446 | B1 | 11/2002 | Brother et al. | |
| 6,519,781 | B1 | 2/2003 | Berns | |
| 6,766,529 | B1 * | 7/2004 | Nathan | 2/2.5 |

(Continued)

OTHER PUBLICATIONS

Markworf, Heart-Gard advertisement.

*Primary Examiner*—Tejash Patel
(74) *Attorney, Agent, or Firm*—Lerner, David, Littenberg, Krumholz & Mentlik, LLP

(57) ABSTRACT

A heart protector is described that comprises of an angular body. The angular body will have at least two contact points wherein the angular body is capable of being attached to a garment at said contact points such that the angular body is positioned in front of the heart of a user and said contact points are positioned at locations around the pectoral muscles of the user when said garment is worn by the user.

7 Claims, 9 Drawing Sheets

U.S. PATENT DOCUMENTS

| | | | |
|---|---|---|---|
| 6,810,534 | B2 | 11/2004 | Durkin et al. |
| 6,859,948 | B2 | 3/2005 | Melts |
| 6,910,224 | B2 | 6/2005 | Ikenaga et al. |
| 7,100,216 | B2 | 9/2006 | Matechen et al. |
| 2002/0069454 | A1 | 6/2002 | Beland |
| 2002/0152546 | A1 | 10/2002 | Durkin et al. |
| 2004/0049827 | A1 | 3/2004 | Melts |
| 2006/0277669 | A1 | 12/2006 | Mott |
| 2008/0127401 | A1 | 6/2008 | Cohen |
| 2008/0201828 | A1 | 8/2008 | Kanavage |
| 2008/0250552 | A1 | 10/2008 | Durham |
| 2008/0295231 | A1 | 12/2008 | Wright |
| 2008/0313793 | A1 | 12/2008 | Skottheim et al. |
| 2009/0025126 | A1 | 1/2009 | Crossman et al. |
| 2009/0044319 | A1 | 2/2009 | Lamson et al. |
| 2009/0077723 | A1 | 3/2009 | Mead et al. |
| 2009/0083901 | A1 | 4/2009 | Pardillo et al. |

* cited by examiner

22

ARTIFICIAL DISC

CROSS REFERENCES TO RELATED APPLICATIONS

This application claims priority to provisional application No. 60/898,449 filed on Jan. 31, 2007, the entire disclosure of which is hereby incorporated by reference.

TECHNICAL FIELD

The present invention relates to a heart guard protection device.

BACKGROUND OF THE INVENTION

Commotio cordis is a sudden disturbance of heart rhythm observed nowadays mostly in young people during participation in sports. It occurs as the result of a blunt, non-penetrating impact to the precordial region, often caused by impact of a ball, a bat or other projectile. The impact is transmitted to the heart muscle, and it may affect the heart's electrical activity, causing an arrhythmia, such as an ectopic beat, ventricular tachycardia or ventricular fibrillation. In addition, pre-existing conditions, such as undetected electrical or structural abnormalities in the heart of these individuals, may render individuals more vulnerable.

The best treatment for commotio cordis is to prevent it from occurring. In particular, the use of adequate protective equipment during athletic activity can greatly reduce the occurrence of commotion cordis. The protective equipment must meet certain safety standards; it has to reduce the incidence of the injury it is intended to prevent without increasing the risk for other injuries. Having every lacrosse player wear chest protectors or changing the ball to a "softer" projectile may seem like good ideas, but a scientific approach to the development of safety equipment is critical to ensure risk reduction. There is some basic science evidence that safety baseballs may reduce the incidence of sudden death from chest wall impacts in low velocity sports (T-ball, little league baseball). But deaths have still occurred when the ball has been altered.

Protective equipment changes the way that an athlete plays the game. A chest protector on a defenseman or midfielder would likely lead to more players jumping in front of attackers in an attempt to block high speed shots, which could lead to more tragic events if the equipment does not significantly reduce the risk of commotio cordis.

In theory, a light weight shoulder pad or chest protector with a hard protective shell and a soft padding undersurface over the front of the chest would spread the force of an impact on the chest wall over a wider surface area, thus reducing amount of energy transmitted to the heart after a chest blow. This could reduce the risk of commotio cordis. Any safety equipment recommended must not affect the player's movement or the ability to pass and shoot with both hands. In addition, it ideally should not change the player's actions during the game by giving the wearer an added sense of security. The least obtrusive device that affords the desired protection would be preferred.

SUMMARY OF THE INVENTION

The present invention is a device to protect the athlete from Commotio Cordis. The present invention has a hard piece protective device that is concave in shape and one that bridges the area over the heart so that when hit by a projectile directs the energy away from the center of the heart to the outer areas of the heart cavity greatly reducing the incidence of Commotio Cordis according to medical studies done. The concave piece can be any shape that will bridge the area directly over the heart. The embodiment shown is triangular in shape and has three contact points that are designed to be beside the pectoral muscles, thereby minimizing the effect it will have on the wearer.

The hard piece will be affixed to a garment that'll position the protective piece directly over the heart of the wearer every time he or she puts it on. The hard piece can be affixed to the shirt in a molding process that'll secure the hard piece to the garment fabric by molding an elastomer/plastic of any type over and around the hard piece with the fabric being placed just below the hard piece prior to the molding process. Through the pressure of the molding process, the fabric will bond/laminate with both the hard piece and the soft over molded piece. The hard piece can be affixed to the garment through a myriad of processes, glued, riveted or sewn molded into proper position/place on the garment and still achieve the same results. The points of contact between the hard piece and the garment can be suitably designed to most efficiently disperse the energy and minimize the impact on the wearer's body.

DETAILED DESCRIPTION OF THE DRAWINGS

Figure 1:
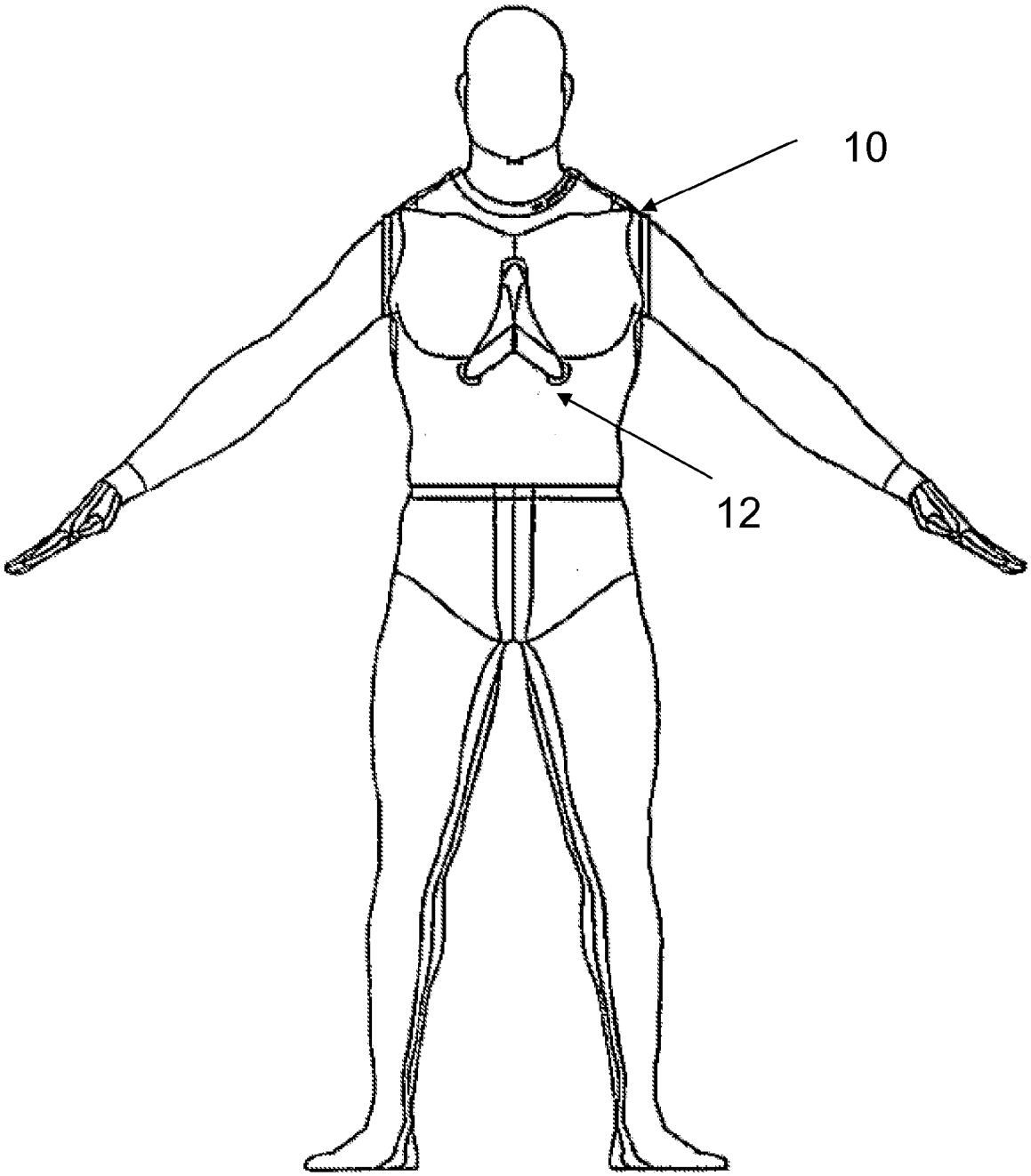
FIG. 1 is a perspective view of a person wearing one embodiment of the present invention.

For the purposes of understanding the invention, reference will now be made to the embodiments illustrated in the drawings. It will be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
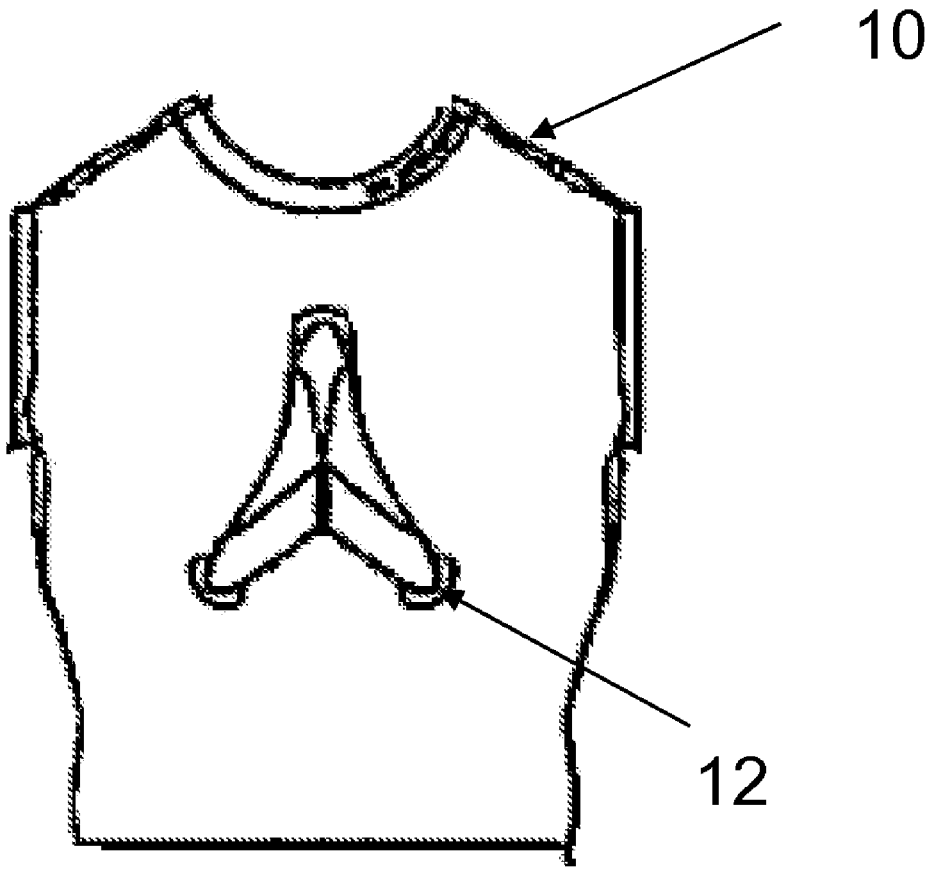
FIG. 2 is a closer view of the invented protective vest in accordance with one embodiment of the present invention.

Referring to FIGS. 1 and 2, one embodiment of the invented protective vest 10 containing the improved heart protector 12 is depicted. FIG. 1 depicts a user wearing the protective vest 10 that has the improved heart protector 12 attached. As can be seen, the heart protector 12 is attached to the protective vest 10 so as to be positioned in the middle of the user's chest in front of where the heart of the user is located.

FIG. 2 shows a closer look at the protective vest 10 and heart protector 12. As can be seen, the protective vest 10 is of the shape of a vest to be worn by an athlete during athletic performance. The vest 10 has suitable openings for the torso, arms and head of the wearer. While a vest is shown, any shape of a garment can be used such that it is worn by the user around the torso. In addition, the positioning of the vest on the user will assist in locating the heart protector 12 over the heart area.

The vest can be composed of any suitable material to be used in sports activity. For example, fabrics that can be used include: cotton or cotton/elastane blend, polyester or poly/elastane blend, nylon or nylon/elastane blend, polypropylene or polypropylene/elastane blend synthetic, natural fiber or any combination thereof. Fabrics that retain their shape and are more form fitting to the user will have the advantage of more accurate placement of the heart protector 12 in front of the heart. In addition, other fabrics, such as meshes, will have the advantage of adhering better to the heart protector 12 during the molding process.

The heart protector 12 can be affixed to the vest 10 in a molding process that will secure the heart protector 12 to the garment fabric. By molding an elastomer over and around and under the legs of the heart protector and through the pressure of the molding process, the fabric will bond/laminate/fuse with and encapsulate the heart protector 12 permanently into position on the garment. Alternatively, the heart protector 12 can be affixed to the garment through a myriad of processes, glued, riveted or sewn molded into proper position/place on the garment and still achieve the same results. In another embodiment, holders can be affixed to the garment fabric at the contact points and the heart protector 12 can be inserted into the holders at the contact points. The holders could be any variety of place holders such as pockets, hooks & loop (velcro) or snaps. In the embodiment shown in FIGS. 1 and 2, the heart protector 12 is shown as contacting the garment at three distinct points, but the contact points with the garment can occur at various different points.

Figure 3:
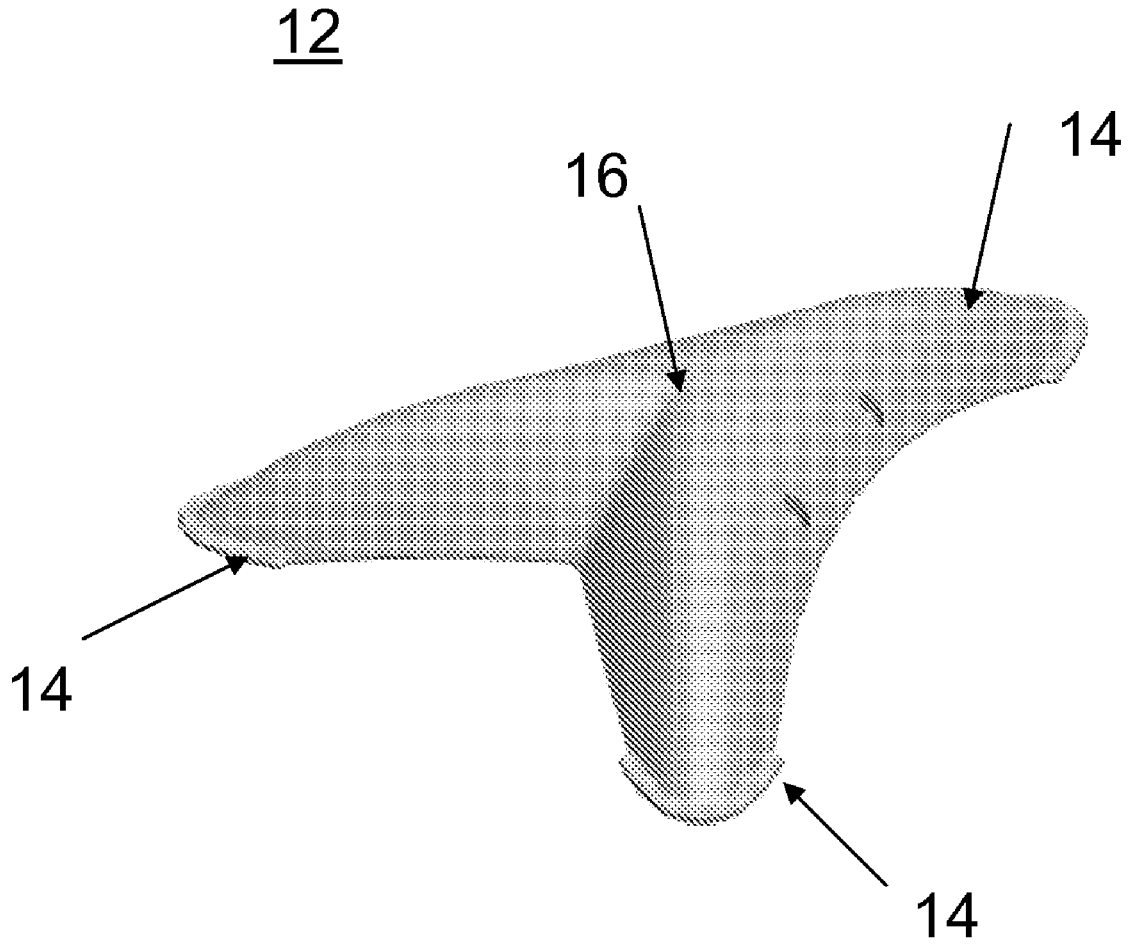
FIG. 3 is a perspective view the plastic shell component in accordance with one embodiment of the present invention.

FIG. 3 shows a perspective view of the heart protector 12. As can be seen, the heart protector 12 has a main concave body 16 and has three legs 14. The three legs 14 extend downward from the concave body 16 and the curvature of the legs generally decrease as the legs taper downward. The ends of the three legs 14 extend far enough from the body such that only the ends of the legs will contact the body of the user when the heart protector 12 contacts the body of the user. Additionally, the curvature of the legs is such that if pressure were placed on the apex of the concave body, the pressure would be distributed throughout the legs. The ends of the three legs 14 have rounded edges 13 and an extension to the legs to stabilize the heart protector 12 as it stands on the legs.

Figure 4:
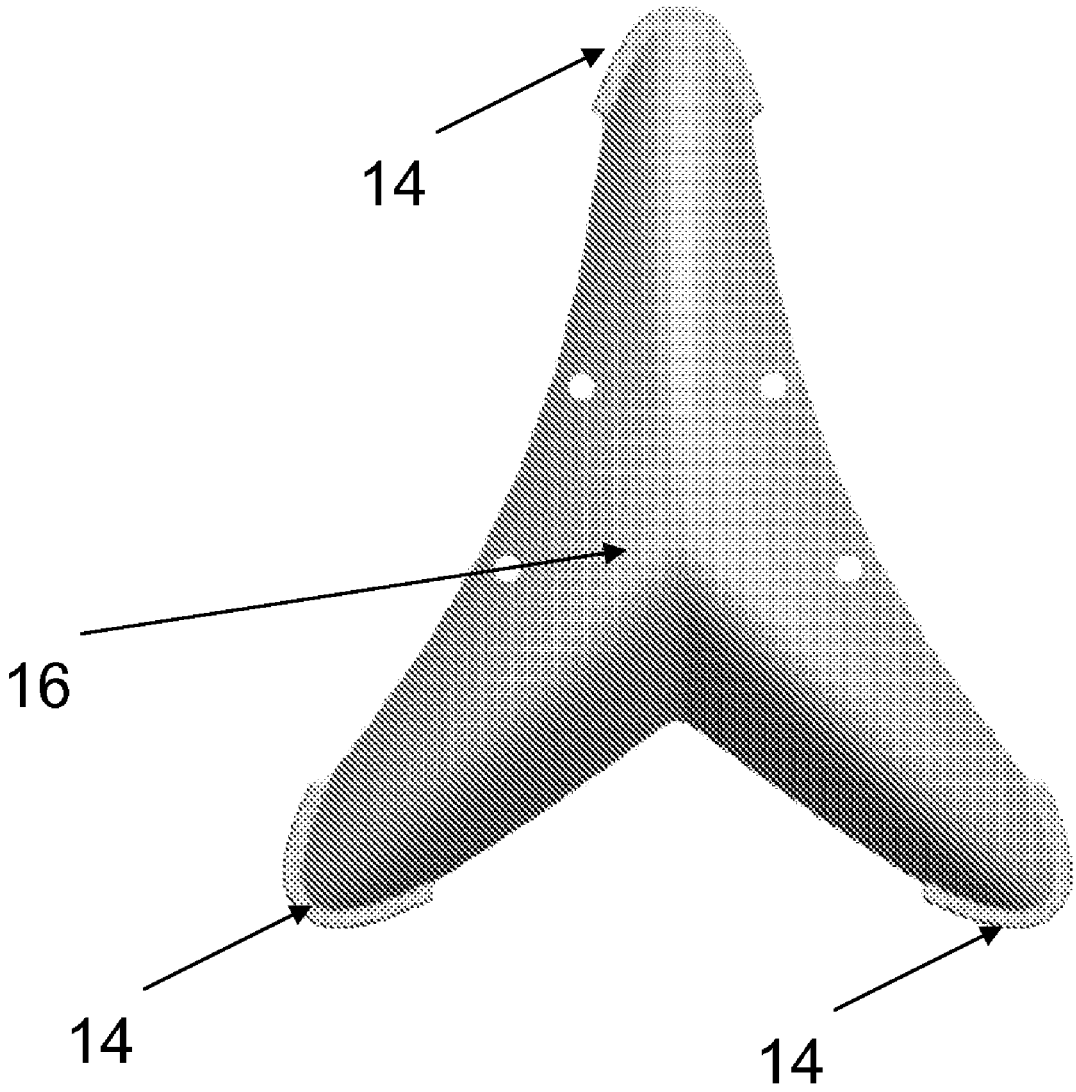
FIG. 4 is a front view of the plastic shell component in accordance with one embodiment of the present invention.

Referring to FIG. 4, which show a top view of the heart protector 12, the three legs 14 will extend outward from the concave body 16 in different directions so as to form a "Y" configuration. Two of the legs 14 will be angled closer together than the third leg. The "Y" configuration is used so that the legs will contact the user's body at the desired positions. The two legs that are closer together are designed to contact the user's body in the area below the pectoral muscle. The third leg is designed to extend between the pectoral muscles and contact the user's body in between the pectoral muscles on the sternum. The exact positioning of the contact between the ends of the legs of the heart protector 12 and the user's body can vary and still be within the scope of the present invention.

Figure 5:
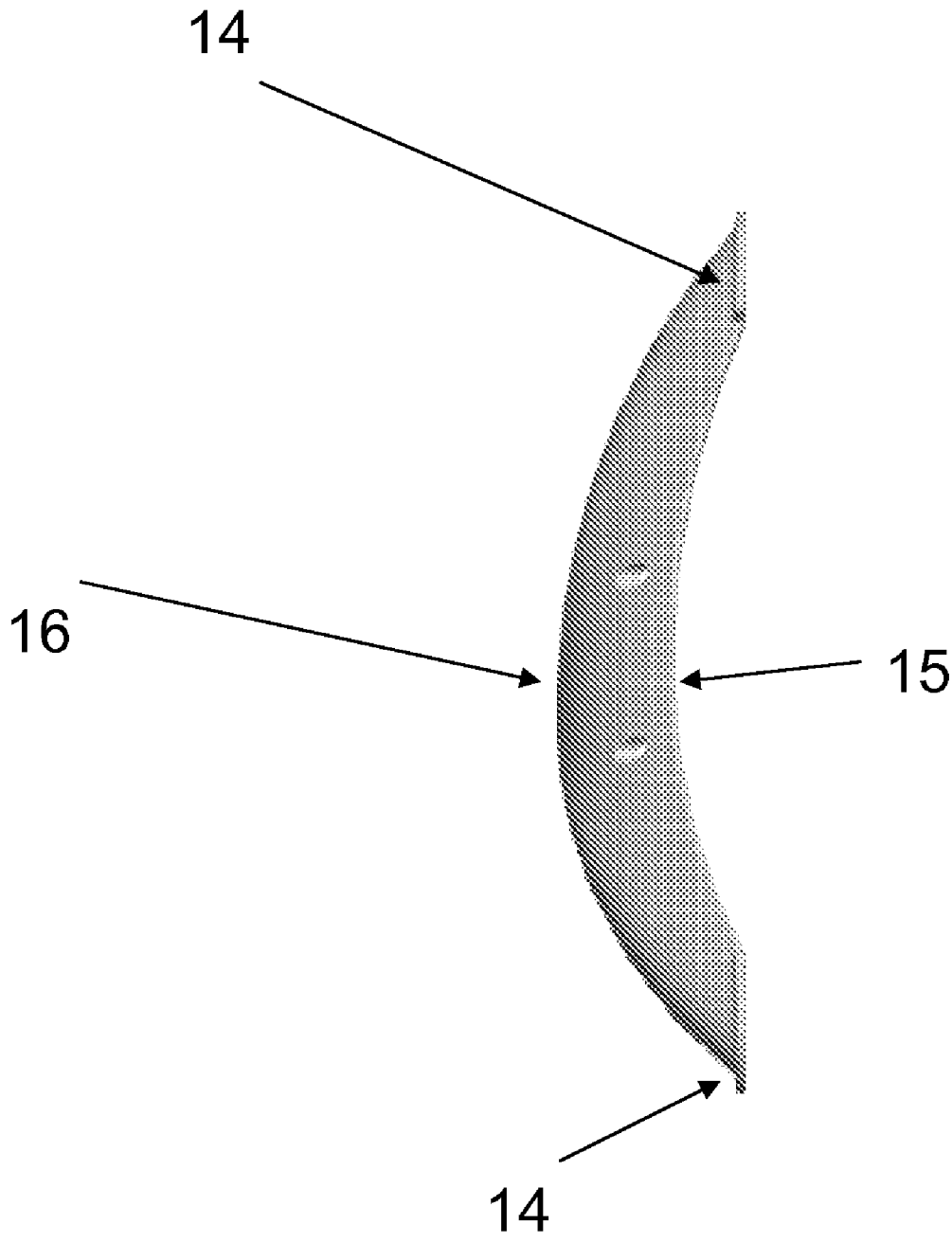
FIG. 5 is a side view of the plastic shell component in accordance with one embodiment of the present invention.

FIG. 5 shows a side view of the heart protector 12. FIG. 5 depicts two of the three legs 14 with the concave body 16 resting above the supporting legs. Between any two legs, there will be a sidewall that is part of the concave body 16 that extends between the two legs. As can be seen, the sidewall will have an arc 15 at the bottom edge so that the heart protector 12 does not contact the pectoral muscle that would lie beneath it. By preventing the hard heart protector 12 from contacting the muscles of the user, the user will be more likely to ignore the presence of the heart protector 12 as he perform his athletic exercises. Moreover, with the sole contact between the user and the heart protector limited to the three leg ends and the bony locations around the pectoral muscles, which are less sensitive, this optimizes the desired effect of providing the most protection while being the least obtrusive.

Figure 6:
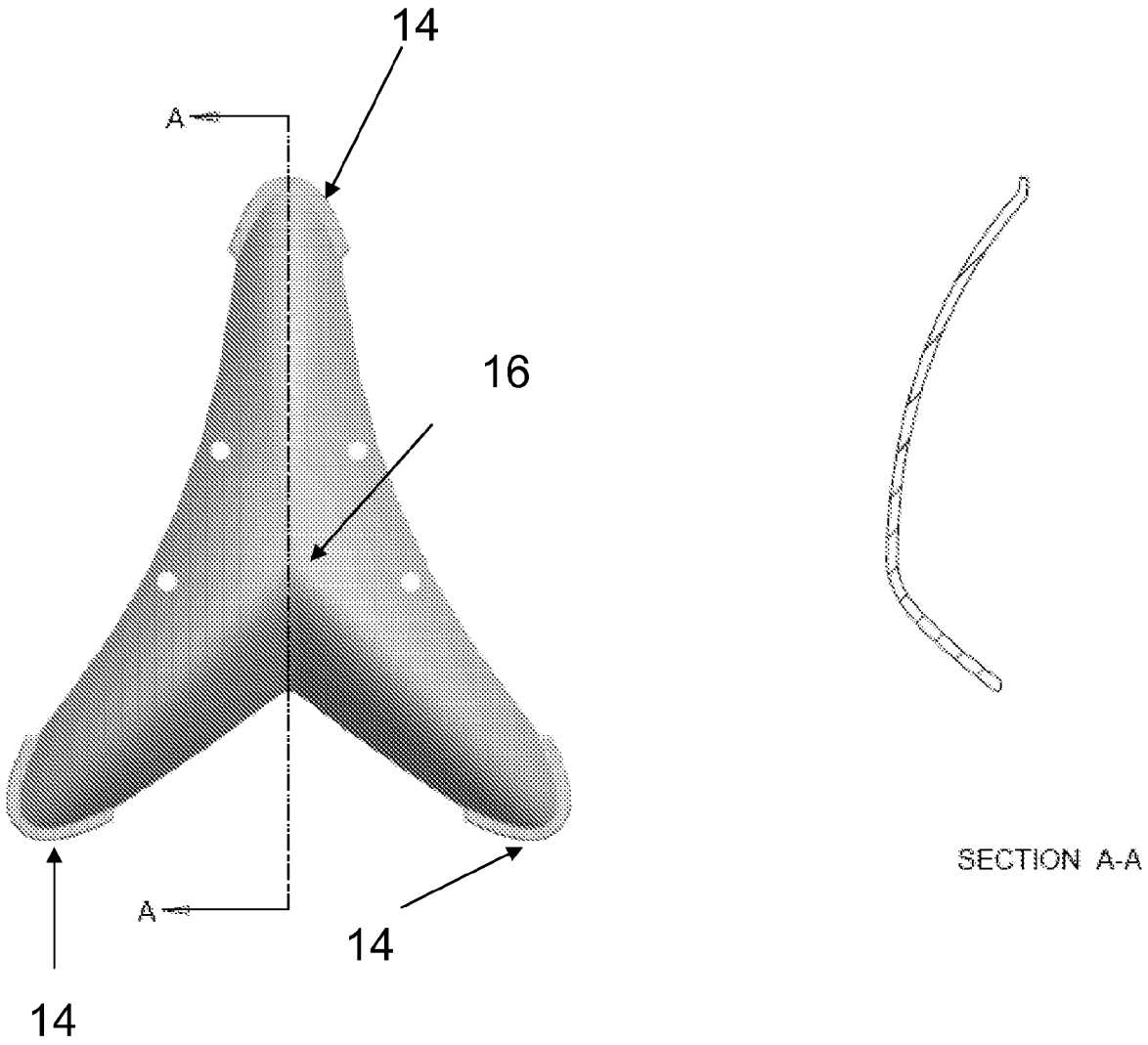
FIG. 6 is a side cutout view along line A of the plastic shell component in accordance with one embodiment of the present invention.

FIG. 6 shows a cutaway side view across the line A-A. As can be seen the curvature of the heart protector 12 is greatest at the apex of the concave body and will gradually lessen as it continues along the legs. The curvature of the concave body at the apex 17 is designed to maximize the protective effect with regard to Commotio Cordis because the apex 17 of the concave body 16 should be directly over the heart of the user. If the user is struck by an object at the apex, the force will be absorbed and spread out amongst the three legs. Since the three legs 14 are in contact with the bony locations below the muscle, the force will be transferred to the skeletal structure of the user, which is designed to withstand impact forces.

Figure 7:
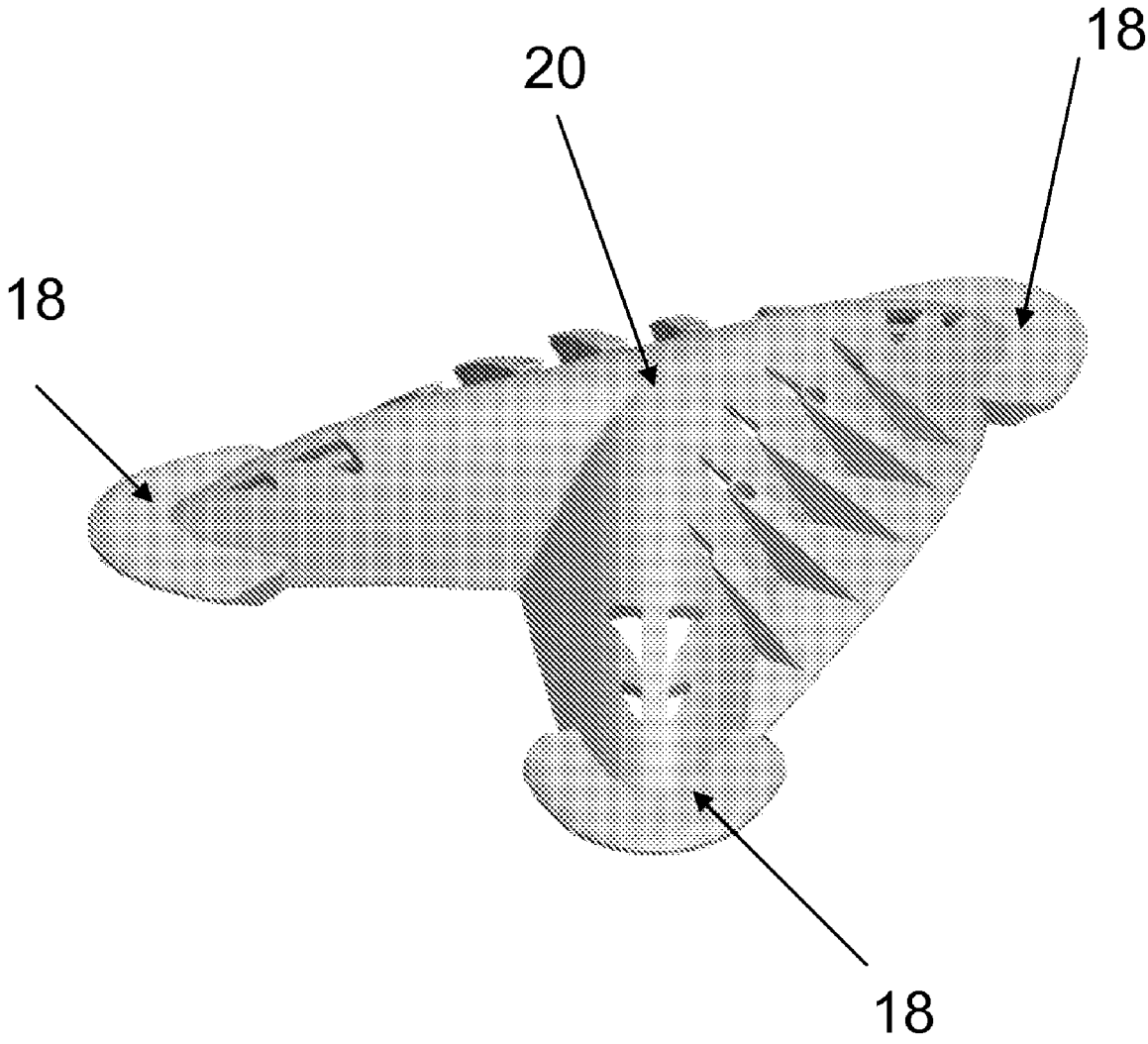
FIG. 7 is a perspective view of the elastomer overlay component in accordance with one embodiment of the present invention.
Figure 8:
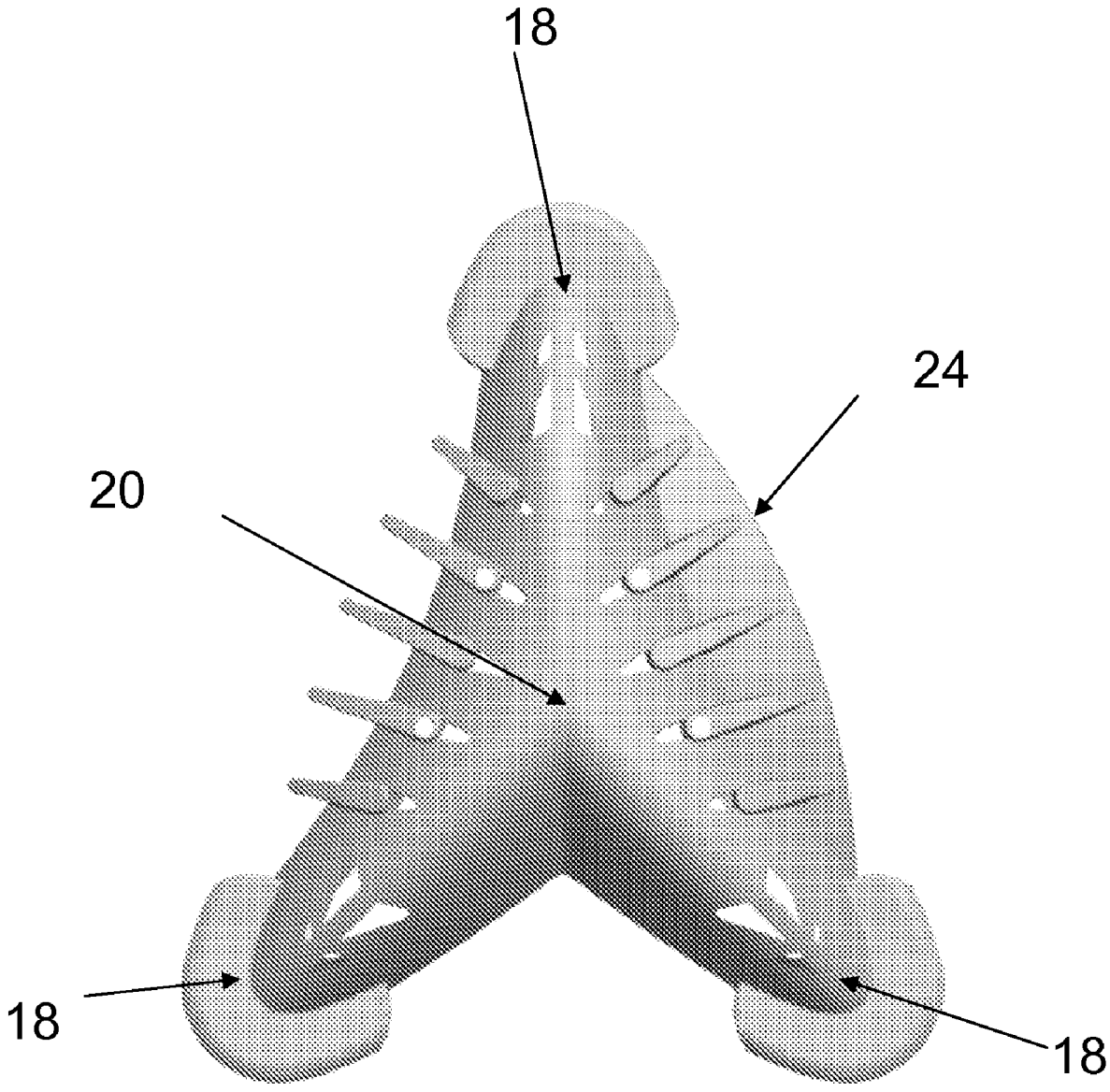
FIG. 8 is a front view of the elastomer overlay component in accordance with one embodiment of the present invention.
Figure 9:
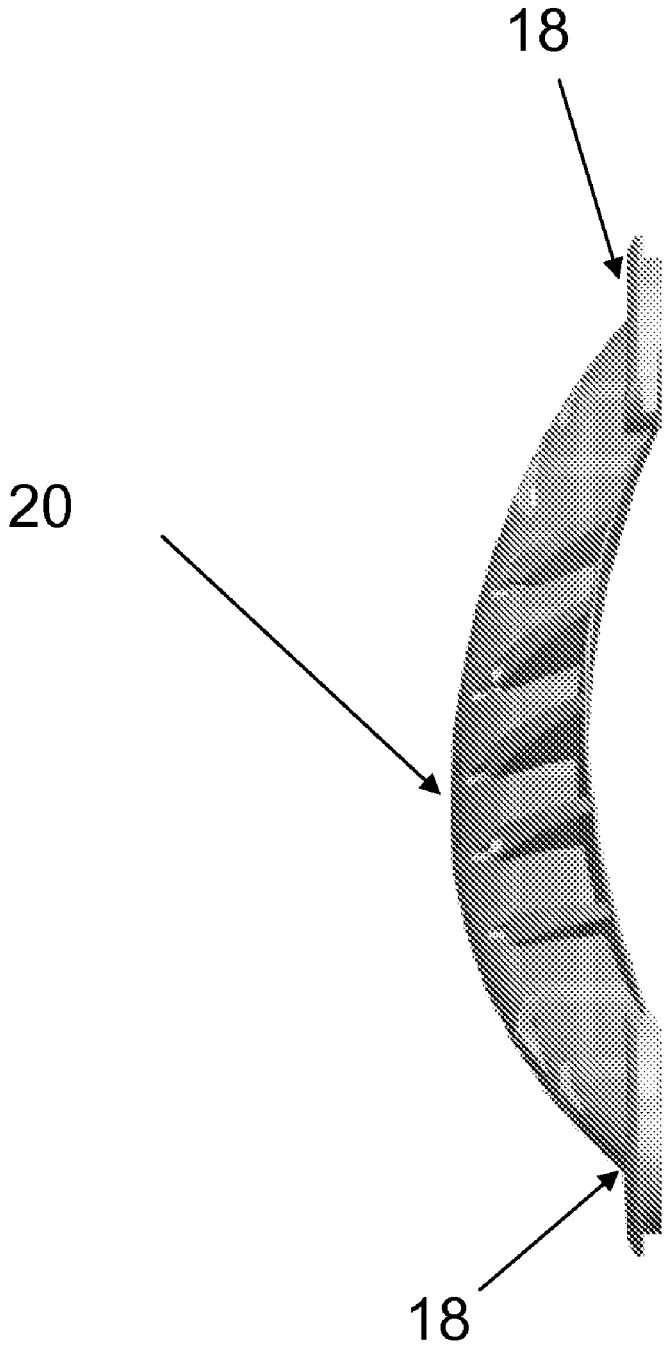
FIG. 9 is a side view of the elastomer overlay component in accordance with one embodiment of the present invention.

FIGS. 7-9 depict another embodiment that can be used in affixing the heart protector 12 to the garment. FIG. 7 shows a perspective view of a elastomer overlay component 22 made in accordance with another embodiment of the present invention. The elastomer overlay 22 will have the same shape as the heart protector 12, including a concave body 20 and three legs 18. The elastomer overlay 22 is designed to fit over the heart protector 12.

The elastomer overlay will assist in absorbing the impact of any blow to the heart protector. The elastomer overlay 22 can be comprised of various materials such as Tpe (thermoplastic elastomer), tpu (thermoplastic urethane), tpo (thermoplastic olefin), epdm rubber, thermoset elastomers, thermoplastic elastomers, elastomereric nylons, or any myriad of hard plastics can also adhere to fabrics. Certain elastomeric compounds have vibration dampening properties, which will assist in protecting against impacts.

The composition of the elastomer overlay can depend on the type of fabric used. Certain fabric/elastomer overlay combinations are better suited to adhere together. For example, nylon elastomer will adhere better to a nylon fabric.

In addition, by molding the elastomer overlay to the garment and having the heart protector 12 be inserted into the elastomer overlay, the hard heart protector does not need to be molded directly onto the garment. This simplifies the molding process and lessens the sensation of the presence of the protector for the user.

The elastomer overlay can have flaps 24 in the spaces between the legs. FIG. 8 shows only one flap existing between two of the legs 18, but other flaps can be placed in the other two spaces. FIG. 9 shows a side view of the elastomer overlay and that the elastomer overlay also has an arc at the bottom of the sidewalls. The elastomer overlay also serves the purpose of giving more surface area to aid in affixing the heart protector to the garment. In addition to molding the legs of the elastomer overlay to the garment, the flaps can also be molded to the garment.

We claim:

1. A heart protector comprising:

a substantially hard concave body having an apex and defining a first concavity;

three legs each defined by a pair of spaced apart sidewalls extending from the apex of the concave body, each of said legs having a concavity in communication with said first concavity, each of the three legs including a first end adjacent to the apex and a second end spaced apart from the apex, the second ends having a contact point adapted to be supported by a body portion of a user of said heart protector; and a polymeric component substantially contiguous with at least a portion of the concave body and said legs.

2. The heart protector according to claim 1, wherein said legs extending away from the apex form a Y-shaped configuration.

3. The heart protector according to claim 2, wherein the polymeric component includes a flap positioned between at least two contact points.

4. The heart protector according to claim 1, wherein the polymeric component is contiguous with exterior surfaces of said concave body and said legs.

5. A heart protection system comprising:

a heart protector comprising a substantially hard concave body having an apex; and three legs extending from the apex, each of the at least three legs having a first end adjacent to the apex and a second end spaced apart from the apex, each of the second ends including a contact point, wherein the contact points of the at least three legs are positioned on the same plane.

6. The heart protection system according to claim 5, further comprising an elastomeric overlay attached to said concave body and said legs.

7. The heart protection system according to claim 5, wherein the at least three legs form a Y-shaped configuration.

* * * * *